US005669700A

United States Patent [19]

Wendel

[11] Patent Number: 5,669,700

[45] Date of Patent: Sep. 23, 1997

[54] LIGHT INTENSITY EQUALIZING ELEMENT FOR LIGHTED DISPLAY PANEL

[75] Inventor: Christopher M. Wendel, Westfield, N.J.

[73] Assignee: Exhibit-Group/Giltspur, Inc., Roselle, Ill.

[21] Appl. No.: 602,699

[22] Filed: Feb. 16, 1996

[51] Int. Cl.[6] ..... F21S 3/00

[52] U.S. Cl. ..... 362/223; 362/225; 362/260

[58] Field of Search ..... 362/217, 223, 362/224, 225, 260, 268, 311

[56] References Cited

U.S. PATENT DOCUMENTS 2,334,005 11/1943 Hoeveller ..... 362/223

2,434,049 1/1948 Nordquist ..... 362/224

3,760,178 9/1973 Miller ..... 362/223

5,270,910 12/1993 Kile ..... 362/260

*Primary Examiner*—Y My Quach

*Attorney, Agent, or Firm*—Joseph H. Roediger

[57] ABSTRACT

An intensity equalizing element for placement between a number of individual fluorescent tubes in a light panel and the panel image display surface. The element includes a like number of curved surfaces in axial alignment with the individual tubes to reduce variation in observed intensity due to tube spacing. Each curved surface is provided with a non-uniform opaque dot pattern thereon to reduce variation in the intensity of light at the panel display surface and enhance uniformity of light intensity throughout an overlying image display.

13 Claims, 2 Drawing Sheets

LIGHT INTENSITY EQUALIZING ELEMENT FOR LIGHTED DISPLAY PANEL

BACKGROUND OF THE INVENTION

This invention relates to improvements in a lighted display panel used for illuminating an image positioned thereon. In particular, the invention is directed to an intensity equalizing element for incorporation in the display panel which provides substantially uniform light intensity for the image being displayed.

In the field of display advertising, the use of large area light display panels has become commonplace. The display panels are generally rectangular in shape with dimensions of the order of 8 feet by 3.5 feet. The lighted display panel is provided with a durable display surface to which an image on film is normally adhered. The size of the display creates a strong commercial impression and has found favor as an advertising tool.

The lighted display panel has a multitude of uses including stand-alone displays, wall mounted and wall-inset displays as well as segmented wall displays incorporated in the modular equipment used in exhibitions and conventions. When used with other components to establish a temporary wall or barrier, it is important that the light display panel have similar dimensions including thickness to enable the display panels to be interconnected with adjacent wall panels.

The purpose of the display panel is to serve as a uniform source of back light for the image to be displayed. The overall impression created by the display is determined by several factors including the uniformity of the light intensity across the display surface. In addition, the heat generated within the display panel is a major factor in determining the useful life of the film affixed to the display surface. For this reason, the use of a plurality of fluorescent tubes within the display panel is favored when compared with incandescent light sources. The fluorescent tubes are typically mounted between the side members of the display in a parallel array with the electrical ballasts being located along the base of the panel. The wiring is located in raceways provided in the side members.

The fluorescent tubes are vertically spaced within the display. This arrangement provides a plurality of elongated light sources spaced from one another and results in a variation in light intensity in the regions between adjacent tubes. In addition, the fluorescent tube is characterized by a variation in light intensity along its length with the central region of the tube having the highest level of illumination. Thus, the large area light display panel has a pronounced series of variations in light intensity in the vertical dimension and a noticeable reduction in light intensity in the horizontal direction viewed from the center region to the outer edges. These variations in the illumination of the display surface detract from the desired impression of the image. Consequently, attention is directed to modifying the large area display panel to reduce these undesired effects.

The closer-spacing of fluorescent tubes within the display panel has practical limits since more individual light sources will generate increased heat. Furthermore, the additional fixtures, ballasts and wiring increase the size, weight and cost of the display panel. While the vertical variations in intensity can be lessened, the increased heat generated coupled with the reduced airspace within the panel causes the temperature at the display surface to increase and the lifetime of the image film to be reduced. The horizontal variation in light intensity is not significantly changed by increasing the number of light sources since the fluorescent tube inherently creates non-uniform illumination along its length.

Various solutions have been proposed for reducing the undesired variations in light intensity in fixtures using fluorescent tubes including the use of curved display surfaces and internal reflecting structures. The U.S. Pat. No. 4,992,916 to Henkes discloses the use of multi-faceted reflecting prisms to provide multiple images of the light sources at the display surface so that the number of tubes in the lighted display appears to have been increased. The structure taught by the reference does not address the variation in intensity along the tube and requires consistent alignment with respect to the individual tubes to achieve a uniform result. The cost of the additional components and the attendant increase in manufacturing cost make this proposed structure undesirable. Furthermore, the use of internal reflective prisms eliminates any possibility of using the display panel for the display of images on the two opposing surfaces.

Another approach to establishing a more uniform light intensity at the surface of a lighted display is shown in U.S. Pat. No. 4,418,378 to Johnson wherein each fluorescent tube is provided with a non-uniform sleeve containing perforations to diffuse and mix the light from each tube. The sleeve, made of metal or plastic, is fitted on each tube with undercut ends facing away from the display surface. A reflectant coating is applied to both inner and outer surfaces of the sleeve to redirect the light and provide a more uniformly lighted display surface. Alternatively, the patent suggests the substitution of a plastic sleeve of varying density to alter the transmission characteristics and compensate for the inherent variation in light intensity of a fluorescent tube. In either case, an individual sleeve is required to be placed on each tube with a particular orientation thereby greatly adding to the cost of manufacture of a display panel. Furthermore, the orientation of the sleeve on each tube must be maintained during use to avoid returning to a non-uniform condition thereby rendering the use of individual sleeves in movable display panels disadvantageous. The disassembly of the display panel is required to reorient the sleeves to the original position for effective use.

Accordingly, the present invention is directed to the provision of a lighted display panel in which a single component is provided to reduce the variation in light intensity from a plurality of light sources contained therein. In addition, the component is configured to permit attachment to the frame of the display panel thereby eliminating the need to remove, fit and replace the individual light sources during installation. Also, the present invention is well-suited for manufacture as a unitary component using conventional molding techniques in order to achieve low cost production, installation and removal.

The lighted display panel constructed in accordance with the present invention is capable of displaying images on front and rear display surfaces with each surface having substantially uniform light intensity both in the vertical and horizontal directions. Furthermore, the display panel is constructed in a manner which permits it to be dimensioned for coupling to adjacent panels for inclusion in modular wall systems.

SUMMARY OF THE INVENTION

The present invention relates to a novel lighted display panel which provides a reduced variation in light intensity at the display surface. The lighted display panel contains a plurality of light sources which are adjacently spaced to create variations in light intensity in a direction normal to the sources. In addition, the use of fluorescent tubes as light sources results in variations in intensity along the tube axis due to the inherent characteristics of the fluorescent bulb. The visual effect of the generation of these variations is substantially reduced at the display surface by the incorporation of a diffusing panel between the sources and the display surface.

The diffusing panel is a large area device with flanges on the opposing sides for attachment to the adjacent sides of the frame of the display panel. The central section of the diffusing panel serves as a light diffuser and includes a plurality of elongated sections each having a raised central region. The elongated sections are in general alignment with the adjacently spaced light sources. The central section of the diffuser panel is interposed between the light sources and the large area display surface, upon which the image to be lighted is displayed.

The light diffuser is connected to the flanges by connectors which extend therebetween. The connectors are angularly disposed to place the flanges at the same level as the tops of the raised portions to provide a diffusing panel of limited thickness for placement between the light sources and display surface. When so positioned, the elongated sections are substantially located at a uniform distance from the surface of the light source. In addition, each light source is spaced adjacent to a curved surface. Thus, the light diffuser is configured to have a corrugated cross-section formed by a plurality of interconnected arcuate sections.

In one embodiment of the invention, the raised central regions of the elongated sections are provided with a pattern of opaque dots distributed along the axis of the section. This embodiment reduces light transmission through portions of the light diffuser as well as diffusing the light transmitted therethrough. The dot pattern is reduced in density outwardly from the center of the elongated sections. The pattern is terminated at a distance from the connectors to permit the light from the end portions of the light source to be diffused without a reduction in intensity. The surface of the light diffuser is in substantial conformance with the surface of the light sources so that light emitted from the sides of tubular fluorescent sources encounters the material of the diffuser and is dispersed thereby to reduce the difference in light intensity in regions between the raised portions of the elongated sections. As a result, variations in observed intensity are reduced and not readily apparent at the image display surface.

The light diffuser provides a equalizing effect to partially compensate for the intensity variation along the length of the light source. Further compensation is obtained through the use of the opaque dot pattern to provide a more uniform intensity throughout the image display surface.

Further features and advantages of the invention will become more readily apparent from the following detailed description of preferred embodiment of the invention when taken in conjunction with the accompanying drawings.

DETAILED DESCRIPTION OF THE PREFERRED EMBODIMENTS

Figure 1:
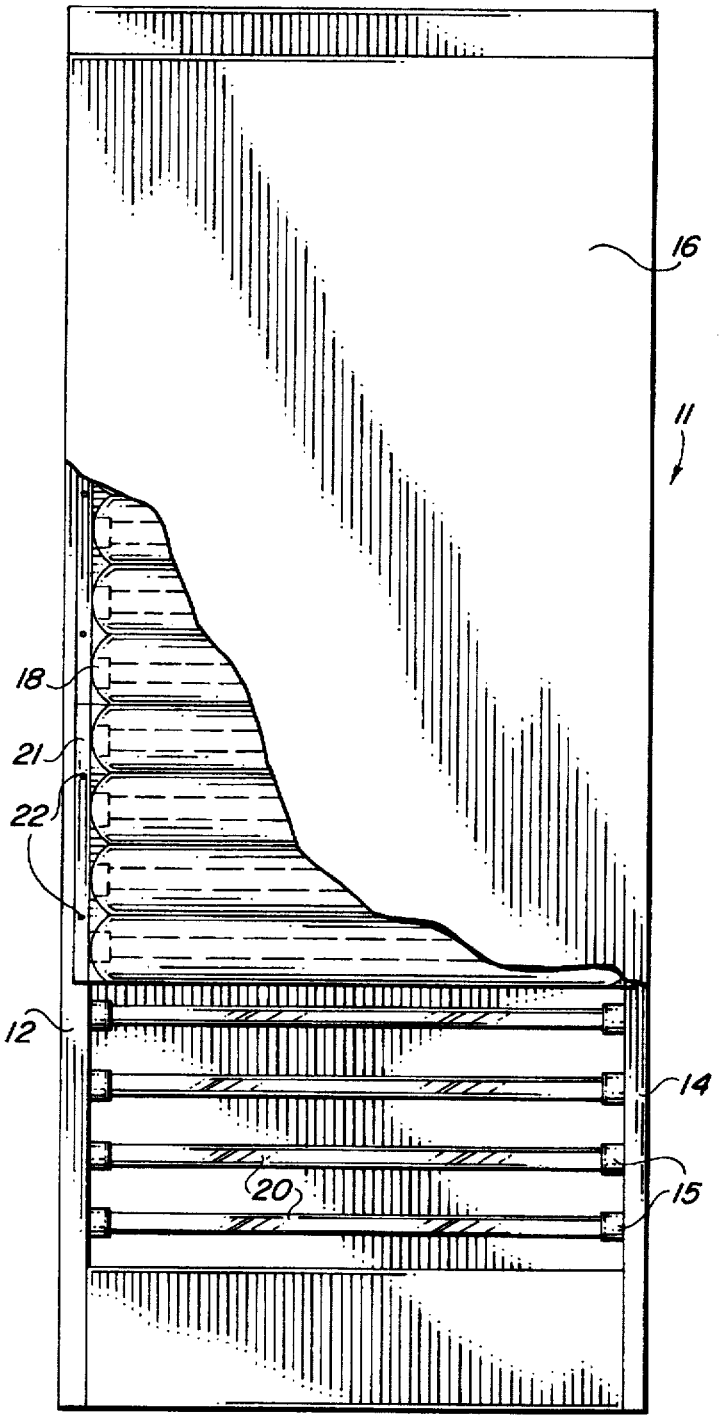
FIG. 1 is a plan view of a display panel with the display surface broken away and the lower light diffuser removed.

Referring now to FIG. 1, a display panel utilizing the present invention to provide a substantially uniform light intensity for an image being displayed at its large area surface is shown.

The display panel 11 includes side members 12 and 14. The side members are provided with a plurality of fixtures 15 which receive adjacently spaced fluorescent tubes 20 therein. While other light sources may be used in certain applications, large area display panels are most effectively lighted with fluorescent lamps in a tubular configuration so as to reduce the amount of heat generated within the display panel. The vertical spacing of the fluorescent lamps is determined by the amount of airspace needed between the lamp to permit heat to be radiated in the closed display panel and the power of each of the lamps. The electrical connections for the individual fixtures are contained in raceways included in the side members of the frame The electronic ballasts are solid state and are positioned in the bottom portion of the display panel. Since these components play no part in the subject invention, they are neither shown nor described further in the specification.

Figure 2:
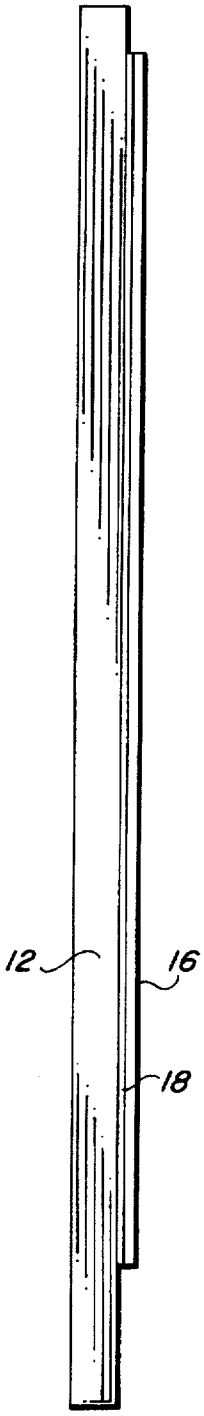
FIG. 2 is a side view of the display panel of FIG. 1.

The display panel 11 is shown in a partial cut-away view with the image display surface 16 removed from the bottom portion thereof. The large area planar surface may be fabricated from plexiglass which provides a flat surface for the adherence of the display image thereto and limited diffusing qualities for light passing therethrough. As shown in FIG. 1, a diffusing panel 18 is interposed between the image display surface 16 and the fluorescent tubes 20. The embodiment of FIG. 1 includes a plurality of individual diffusing panels 18 each of which overlies a number of fluorescent tubes. The lowermost diffusing panel is removed in FIG. 1 to show the orientation of the tube and fixtures. The diffusing panels include a flange 21 which is provided with holes for fasteners 22 to attach the panels removably to the side member 12. A like connection is made to side member 14. The image display panel 16 overlies the flanges 21 and the width of the side member 12 to provide a degree of protection for the diffusing panel and the internal parts within the display panel 11. The view in FIG. 2 shows the relationship between display surface, diffusing panel and side member.

In the embodiment of FIG. 1, the structural members of the lighted display panel are made of aluminum to reduce the overall weight thereof. The width of the panel is about 40", the height is 96" and the overall width is 2.5". The thickness of the display panel is normally dictated by the adjacent modular panels used in display and exhibit furnishings. Thus, any additional components added to the standard modular display panel are required to enable the thickness dimensions to be essentially maintained at this relatively thin dimension. In the embodiment shown, the fluorescent lamps were spaced four and five-eighths inches apart and are 20 in number. As mentioned previously, the lighting of the fluorescent lamps heretofore has resulted in a light intensity at the display surface which varies through successive maxima and minima in the vertical direction due to the spacing of the tubes. In addition, the inherent variation in light intensity from a fluorescent tube lamp results in minimas occurring near the outer edges with a central maxima.

These undesirable variations are normally quite apparent to the viewer of an image displayed on the display surface.

Figure 5:
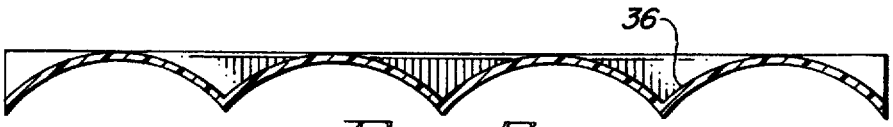
FIG. 5 is a view in cross-section taken along line 5—5 of FIG. 3.
Figures 3, 4, 6:
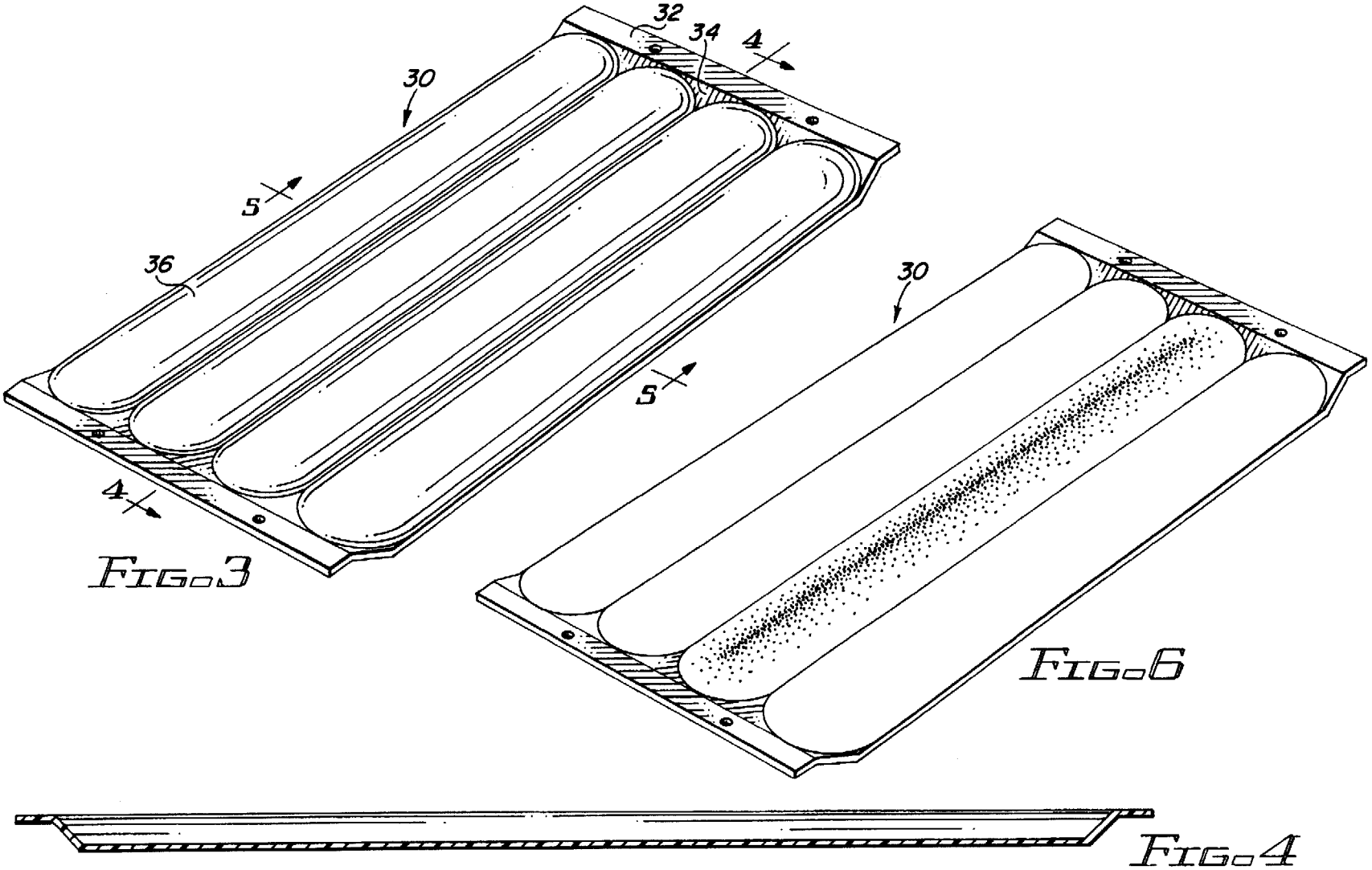
FIG. 3 is a view in perspective of one embodiment of a light diffuser for placement in the display panel of FIG. 1.
FIG. 4 is a view in cross-section taken along line 4—4 of FIG. 3.
FIG. 6 is a view in perspective of another embodiment of a light diffuser for placement in the display panel of FIG. 1

The present invention is directed to substantially eliminating the variations in light intensity at the display surface by the use of the diffusing panels incorporated within the display panel. One embodiment of a diffusing panel is shown in the perspective view of FIG. 3. The light diffuser 30 has a plurality of elongated sections 36 each having a raised central region when taken in cross-section. The cross section is shown in FIG. 5 wherein the raised central region is arcuate and joined to the adjacent arcuate regions along the length dimension. As shown in FIG. 3, the cross section in FIG. 5 is taken along line 5—5 and viewed along the axis of the raised central region. The central regions terminate at the opposing flanges 32 and are connected at their ends by a connector 34 to the flange 32 so that no uncovered path for light is present. When in position, the flanges 32 are affixed to the side member of the frame as shown in FIG. 1.

The elongated sections of the light diffuser extend in width from the midpoint of the space between adjacent fluorescent tubes. The light emitted by a fluorescent tube in a direction other than perpendicular to the central region of the elongated section encounters a curved surface and is dispersed to supply additional light to the regions between adjacent fluorescent tubes. The provision of a continuously curved surface across the light diffuser has been found to provide a substantially uniform light intensity thereacross. When the image display surface is viewed in the embodiment shown, the variations in light intensity in the vertical direction are not readily apparent to the viewer.

In addition, the effect of the light diffuser also compensates in part for the inherent characteristic of the fluorescent tube in having a reduced light intensity toward its outer ends.

The light diffuser is made integral with the connectors which secure the flanges. The connectors fill the spaces between the ends of the elongated sections as shown in the cross-section view of FIG. 4 taken along line 4—4 of FIG. 3. The elongated sections are truncated so that the raised central portion extends further outwardly toward the side member of the frame. The connectors are angularly disposed at approximately 45 degrees to fill all spaces between flange and the light diffuser 30. The diffusion characteristics of the material proximate to the flanges aides in reducing the dark regions at the ends of the fluorescent tubes. In addition, the light diffuser 30 is sufficiently reduced in thickness due to the angular disposition of the connectors so as to permit placement on opposing sides of the fluorescent tubes. This configuration enables the lighted display panel to have two image display surfaces without unduly increasing the thickness of the panel itself and thereby adversely effecting its compatibility with adjacent modular furnishings. This feature is especially important in the exhibition and convention use of the display panels wherein the modular furnishings and their attachment means are standardized to permit rapid set-up and knock-down.

The embodiment of the diffusing panel shown in FIGS. 3, 4 and 5 can be provided with an opaque dot pattern to further reduce the variation in light intensity across the display panel. The embodiment of FIG. 6 shows an opaque dot pattern formed on the central region of one of the elongated sections in the light diffuser 30. The pattern is shown on only one by way of example. However, it is to be noted that it is preferably included on all elongated sections. The dot pattern introduces a degree of opacity that is greatest in the center of the elongated section and its density varies from a maxima at the center to minimas axially spaced therefrom. The pattern terminates prior to reaching the ends of the elongated section since the fluorescent tube produces its lowest output light level proximate to the ends of the elongated section. The dot pattern is formed on each of the elongated sections by using silk screening techniques. The reduction of the highest intensity at the center maxima serves to reduce the variation in light intensity across the image display surface. The combination of the curved light diffuser and the opaque dot pattern have been found to produce an essentially uniform lighted display surface.

The diffusing panel is typically formed of polystyrene and is relatively thin so that it can be formed by vacuum molding techniques. The use of four or five section overlays for the diffusing panel is preferred to facilitate handling of the thin structure. This feature has been found to be important when a fluorescent tube has to be replaced due to failure in the display panel.

The overlying image display surface is typically formed of plexiglass since it provides a durable substrate for receiving the image film thereon. However, the use of fibrous paper containing glass fibers has been found to provide additional dispersion of the light further eliminating variations in light intensity across the image surface. In the case of the use of the paper as a large area display surface, the image is printed directly on the paper rather than on film adhered thereto.

While the above description has referred to specific embodiments of the invention, it is to be noted that variations and modifications may be made therein without departing from the scope of the invention as claimed.

I claim:

1. A diffusing panel for placement in a lighted display to provide a substantially uniform distribution of light from multiple spaced light sources positioned between opposing members of a frame, said panel comprising:

a) first and second flanges for affixation to opposing members of the frame;

b) a light diffuser overlying a plurality of said light sources and extending between said first and second flanges, said diffuser including a plurality of adjacently positioned elongated sections having first and second adjacently positioned ends and a longitudinal axis extending therebetween, each elongated section having an arcuate cross-section and a raised central region extending between the first and second positioned ends in alignment with the longitudinal axis, said diffuser having a continuously curved surface formed by the adjacently positioned elongated sections, and c) first and second connectors securing the first and second positioned ends of the elongated sections to the first and second flanges respectively, each of said connectors angularly extending between the elongated sections and the flanges respectively so that said flanges are in substantial alignment with the raised central region of the elongated sections.

2. The diffusing panel in accordance with claim 1 wherein said first and second connectors are each formed integral with the respective positioned ends of the elongated sections.

3. The diffusing panel in accordance with claim 2 wherein said light diffuser and said first and second connectors are formed of translucent material.

4. The diffusing panel in accordance with claim 2 further comprising an opaque pattern located on the raised central region of each of the elongated sections, said pattern extending laterally along the axis of the elongated section.

5. The diffusing panel in accordance with claim 4 wherein said pattern has a density varying from a maxima centrally located on the elongated section to minimas axially spaced therefrom.

6. The diffusing panel in accordance with claim 5 wherein said pattern terminates proximate to the positioned ends of the elongated section.

7. The diffusing panel in accordance with claim 6 wherein said opaque pattern comprises a dot pattern formed on the raised central region of each elongated section.

8. A lighted display panel containing a plurality of light sources which comprises:

a) a frame having a top, a bottom and first and second opposing side members, said side members having an equal thickness and including a plurality of light source receiving sockets;

b) a large area cover for attachment to the frame, said cover providing an image display surface;

c) a plurality of light sources received in said sockets;

d) a diffusing panel extending between said side members and overlying at least two light sources; said diffusing panel comprising:

i. a light diffuser having a plurality of elongated sections, each of said elongated having a longitudinal axis and an axially extending raised central region;

ii. first and second flanges for attachment to the first and second opposing side members, and iii. first and second connectors angularly extending and secured between the light diffuser and the first and second flanges respectively and placing said flanges in substantial alignment with the raised central region of the elongated sections whereby the diffusing panel is interposed between said light sources and said cover.

9. The lighted display panel in accordance with claim 8 wherein each of the elongated sections of the light diffuser has an arcuate cross-section and is adjacently positioned to provide a series of curved surfaces for the diffuser.

10. The lighted display panel in accordance with claim 8 further comprising an opaque pattern located on the raised central region of each of the elongated sections, said pattern extending along the axis of each of said elongated sections.

11. The lighted display panel in accordance with claim 10 wherein said pattern has a density varying from a maxima centrally located on of the elongated section.

12. The lighted display panel in accordance with claim 11 wherein said pattern comprises a dot pattern formed on the raised central region of each of said elongated sections.

13. The lighted display panel in accordance with claim 12 wherein said light diffuser and said first and second connectors are formed of translucent material.

* * * * *